United States Patent [19]

Watkins

[11] 4,132,441

[45] Jan. 2, 1979

[54] HEAD FOR REMOVING FUSE HOLDER

[76] Inventor: Murrell W. Watkins, 703 S. Woodlawn, Okmulgee, Okla. 74447

[21] Appl. No.: 842,597

[22] Filed: Oct. 17, 1977

[51] Int. Cl.[2] ..... A47F 13/06

[52] U.S. Cl. ..... 294/19 R; 81/3.8; 81/53.1

[58] Field of Search ..... 294/19 R, 23, 86 H, 294/875 H, 92, 99 R, 102 R; 81/53.1, 3.8

[56] References Cited

U.S. PATENT DOCUMENTS

| | | | |
|---|---|---|---|
| 2,514,489 | 7/1950 | Halvorsen | 294/19 R |
| 3,534,993 | 10/1970 | LeVesque, Sr. | 294/19 R |

*Primary Examiner*—James B. Marbert

*Attorney, Agent, or Firm*—Head, Johnson & Chafin

[57] ABSTRACT

An improved hot stick and head therefor for removing a fuse holder from a line mounted fuse type disconnect switch in which the fuse holder is of the type having a tubular body in which the fuse is retained and having an eyelet extending radially outwardly near one end of the tubular body, including a pole adapted to be held in the hands of the user standing on the ground and of a length to reach up to the height at which fuse type disconnect switches are mounted. The pole may be of the telescopic type, a tubular opened top fuse holder catcher dimensioned so that the internal diameter is large enough to freely and slidably receive the tubular fuse holder, the catcher having a slot in one side extending from the open top to near the bottom, the slot being tapered at the top so that when a fuse holder is hanging downwardly and suspended from its upper end, the catcher may be slid upwardly over the fuse holder with the eyelet being slidably received in the slot to thereby permit the fuse holder to be lifted out of its suspended position, including means of attaching the tubular catcher to the upper end of the pole and including a hook member extending radially from the upper end of the pole, the hook member being usable to insert into the eyelet of a fuse holder from pivoting the fuse holder to the opened or closed position.

1 Claim, 4 Drawing Figures

HEAD FOR REMOVING FUSE HOLDER

BACKGROUND AND OBJECTS OF THE INVENTION

Most electrical distribution facilities in the United States and other parts of the world utilize above-ground highlines. To provide for easy disconnect of the above-ground circuits, and also to provide a fuse to protect overhead circuits, a common type of device utilized in the electrical distribution industry is a line mounted fuse holder for fuse type disconnect switches. These type fuse holders are typically formed of a tubular body which receives the replaceable fuse link. At one end of the tubular fuse holder a means is formed for pivotally suspending the fuse holder in a removable carriage system. Typically, the means for suspending the fuse holder includes opposed boss portions which extend radially outward from one end of the tubular fuse holder body, the boss portions being received in opposed slots in a fuse carriage which is mounted to a highline pole. The other end of the tubular fuse holder typically includes a radially extending eyelet, the purpose of which is to provide a means of pivoting the fuse holder about the support arrangement at the opposite end by inserting a hook affixed to the end of a hot line pole into the eyelet.

Fused switches of the type described typically include an additional feature such that when a fuse link blows by overcurrent, the fuse holder is automatically released from its closed position and pivots to hang with the eyelet end extending downwardly. The repairman, when he finds a blown fuse, must retrieve the fuse holder to replace the internal fuse link. In the past, this has been done by using a hot stick which is a long pole adapted to be held in the hands of the user standing on the ground surface. The upper end of the pole has a radilly extending hook. The user inserts the hook into the eyelet and by moving the fuse body upwardly disengages the pivoted support end of the fuse holder from the fuse carriage. The fuse holder is then suspended by the eyelet on the hook and the pole may be lowered to the ground, thereby retrieving the fuse holder.

One problem with the hot stick and head of this type which employs only a hook member is that frequently in attempting to dislodge the fuse holder from its carriage the fuse holder eyelet becomes disengaged from the hook and the fuse holder can fall to the ground with the result that the operator, or anyone else standing on the ground, may be injured. Another difficulty with the existing type of hot sticks having only the hook member is that it is difficult to raise a replacement fuse holder and position it such that the retaining end is properly placed in the fuse carriage before the fuse holder is pivoted into its upper closed position.

The present invention is directed towards an improvement over the existing type of hot sticks used by electric utility company linemen. The invention includes a means of more effectively grasping a tubular type fuse holder for removing it from its carriage member and lowering it to the earth's surface. In addition, the invention provides a head for a hot stick which enables the user to more effectively replace the fuse holder into its carriage, thereby reducing the possibility that the fuse holder will be inadvertently dropped either during retrieval or placement of the fuse holder from its highline fuse carriage.

It is therefore an object of this invention to provide an improved hot stick and head therefor for removing a fuse holder from a line-mounted fuse type disconnect switch.

More particularly, an object of this invention is to provide an improved head for a hot stick including a tubular fuse holder catcher for receiving a suspended tubular type fuse holder providing an arrangement wherein the fuse holder may be more easily removed from a fuse carriage or replaced into a fuse carriage.

These general objects, as well as other and more specific objects of the invention will be set forth in the following description and claims, taken in conjunction with the attached drawings.

DESCRIPTION OF VIEWS

SUMMARY OF THE INVENTION

An improved hot stick and head therefor is provided for removing a fuse holder from a line mounted fuse type disconnect switch of the type where the fuse holder has a tubular fuse body and an eyelet extending radially outwardly from one end of the tubular body and a suspension portion at the other end, the hot stick including a pole adapted to be held in the hands of the user, the pole being of a length to allow the user to stand on the ground and reach up to a pole-mounted fuse type disconnect switch, the head affixed to the upper end of the hot line pole including a tubular open top catcher of internal diameter greater than the external diameter of the fuse holder, the tubular catcher having a slot in one side extending from the top down to near the bottom, the upper end of the slot being tapered, the slot being of a width to slidably receive the fuse holder eyelet so that the catcher may be slipped upwardly over a downwardly hanging fuse holder, with the eyelet received in the slot allowing the fuse holder to be urged upwardly to disengage it from the disconnect switch, and the pole having a hook member affixed to the upper end, the hook member extending radially of the axis of the pole, the hook member being insertable into a fuse holder eyelet to pivot it into or away from the closed position.

DETAILED DESCRIPTION OF THE PREFERRED EMBODIMENT

Figure 1:
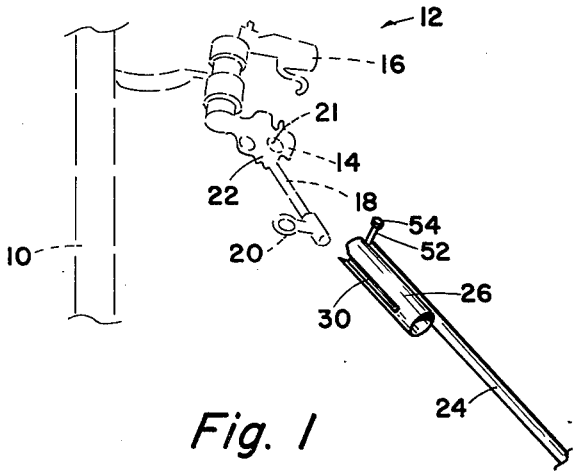
FIG. 1 is an isometric view showing a pole mounted fuse type disconnect switch in dotted outline and showing the upper end of the improved hot stick and head therefor of this invention as the hot stick is raised into the position preparatory for retrieving the fuse holder.

Referring to the drawings and first to FIG. 1, the upper portion of a power line is shown in dotted outline having a fused switch generally indicated by the numeral 12. The fused switch 12 has a lower portion 14 and an upper portion 16. Portions 14 and 16 are insulated from each other, the gap therebetween being closed by a fuse to complete a circuit. Suspended from the fuse lower portion 14 is a fuse holder 18 of the type having a tubular body with a radially extending eyelet 20 at the lower end and another eyelet 21 at the upper end. The fuse holder 18 includes a suspension means 22 at the upper end. The fuse holder 18 is of the type which internally receives a fuse linkage and is arranged so that the fuse holder 18 is placed in the fuse switch lower portion 14 and pivoted upwardly to engage the upper portion 16 of the switch. Further, the fuse holder 18 is of the type such that when the fuse linkage blows by an over current condition, the fuse holder drops down to the position shown in FIG. 1 to serve as a means of indicating to repairmen that the fuse has blown and to facilitate removal of the fuse holder for replacement of the blown fuse. Typically, the fused switch 12 is mounted on pole 10 high above the ground. The repairman, in order to replace a blown fuse, must retrieve the fuse holder 18 and bring it to the ground to replace the burnt out fuse linkage. After the fuse linkage has been replaced in the fuse holder, the holder must be raised back into position and suspended from the lower portion 14 of the switch 12, after which the fuse holder 18 must be pivoted so that the portion having eyelet 20 is moved upwardly to engage the switch upper portion 16. While a repairman could climb pole 10 to perform this function, such method is dangerous and time consuming. Instead, in the typical present method, a repairman utilizes a long pole or hot stick having a hook member. The repairman raises the hot stick and inserts the hook in eyelet 21. The fuse holder is then urged upwardly to disengage the fuse holder suspension end 22 from the switch lower portion 14. The fuse holder 18 may then be brought back to the ground by lowering the hot stick as long as the eyelet 21 remains received about the hot line hook member. Frequently, however, in attempting to disengage the fuse holder, or to replace it in position after a new fuse linkage has been installed, the eyelet becomes disengaged from the hook, and the fuse holder falls, endangering the repairman.

Figure 2:
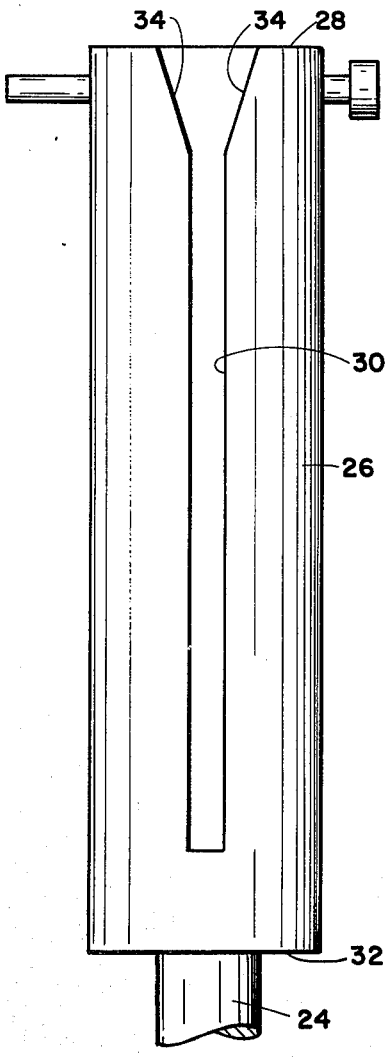
FIG. 2 is a front elevational view of the upper end of the hot stick with the improved head.

The present invention adds to a hot stick 24 a tubular fuse holder catcher 26. As best shown in FIG. 2, the fuse holder catcher 26 has an open top 28. A slot 30 is formed in one side, the slot extending from the open top to near the fuse catcher bottom 32. The slot 30 is of a width to slidably receive the fuse holder eyelet 20. Preferably, slot 30, as illustrated, is outwardly tapered 34 at its upper end to facilitate the reception of the fuse holder eyelet 20 within the slot. The internal diameter of the fuse holder catcher 26 is large enough to freely receive fuse holder 18.

Figure 3:
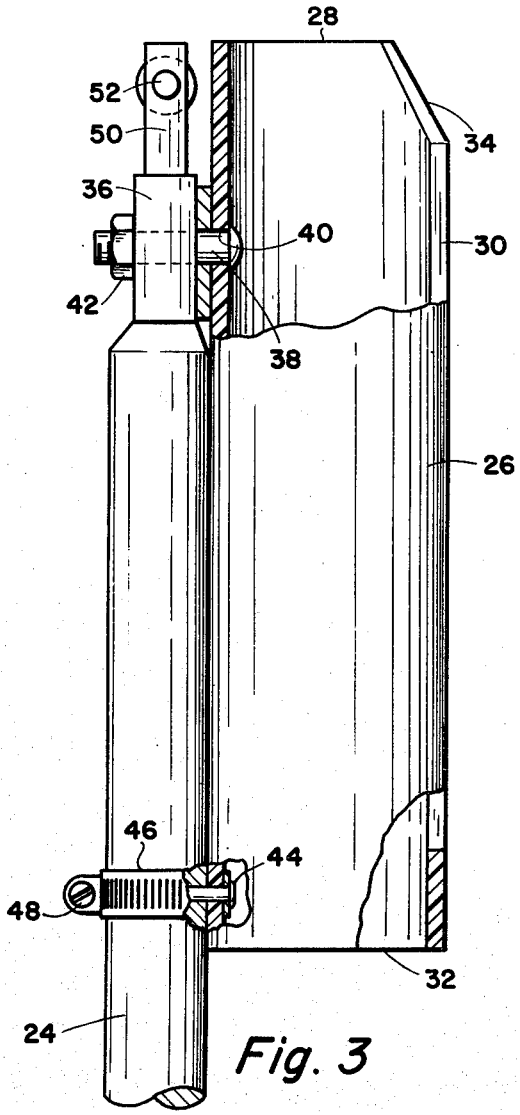
FIG. 3 is an elevational view, shown partially in cross section, of the upper end of the hot stick and improved head.

Referring to FIG. 3, the means whereby the fuse holder catcher is mounted to hot stick 24 is best illustrated. The hot stick 24 has, at its upper end, a flat plate 36. A bolt 38 extends through an opening 40 formed into one side of the fuse holder catcher 26. Opening 40 is preferably directly opposite slot 30. Nut 42 retains the bolt and thereby the fuse holder catcher 26 so that the tubular axis of the catcher 26 is parallel the axis of pole 24.

Adjacent the bottom 32 a rivet 44 attaches a band 46 of the type such as a hose clamp band. The band 46 encircles pole 24 and is tightened by bolt 48. The lower portion of catcher 26 is thus firmly secured to the hot stick.

Figure 4:
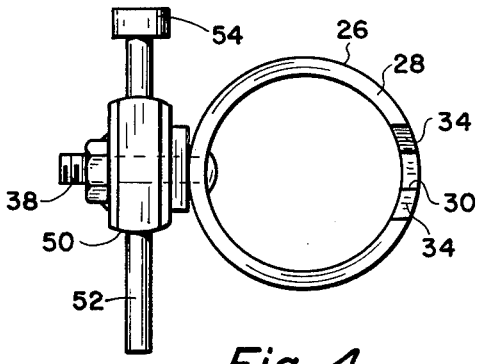
FIG. 4 is a top view of the upper end of the hot stick and the improved head.

The flat plate 36 at the upper end of hot stick 24 has an upper extension 50 which receives a hook member 52, also shown in FIG. 4. The hook member preferably has a head 54 at one end. The length of the hook member 52 may vary. The hook member extends radially of the pole 24 and radially of the plane of the tubular axis of catcher 26. Normally, elements 50, 52, and 54 are formed of one integral piece, and hook member 52 may be bent or curved, rather than straight as illustrated.

METHOD OF USE

When a fuse body 18 which has blown and is hanging downwardly in the position shown in FIG. 1 is to be removed, the hot stick 24, which may be a single length, is preferably telescopic, is raised and catcher 26 is slid upwardly to receive the fuse holder 18, the eyelet 20 being received in slot 30. In this position the fuse holder 18 may not be easily dislodged. Further upward force on hot stick 24 dislodges the upper end 22 of the fuse holder from the switch lower portion 14. The fuse holder may then be lowered to the earth's surface for replacement of the blown fuse linkage.

When the fuse is to be reinserted into the fuse device, it is positioned in the holder with the eyelet 20 in slot 30 and raised into position. The upper end 22 of the fuse holder is positioned in the switch lower portion 14 and the pole is downwardly withdrawn, allowing the fuse holder 18 to be pulled from within the catcher 26. The hook member 52 is then inserted into eyelet 20 and the fuse holder 18 is pivoted upwardly so that the upper eyelet end 20 engages the switch upper portion 16, completing the circuit.

Fuse holder 18 is thereby carried from the switch to the ground or from the ground to the switch at all times within catcher 26. The hook member 52 is used only to pivot the fuse from the opened to the closed position or vice versa; that is, if the fuse linkage is not blown and the fuse is in the closed position, the hook portion 54 may be used to pivot the fuse holder from the closed to the open, downward position to open the circuit and to thereby enable the fuse holder 18 to be removed if desired. It is understood that the pole or hot stick 24, with the hook member 52, functions in its normal arrangement of pivoting the fuse holder from the open to the closed position or vice versa. However, this invention adds the fuse holder catcher 26 for use in transporting the fuse holder from its position in the switch to the surface or from the surface back to the switch, thereby substantially minimizing the chance that the fuse holder will inadvertently fall and possibly injure a workman. In addition, when the device is retained in the fuse holder catcher 26, the upper end of the fuse holder may be more easily positioned to engage the switch lower portion 14, or to disengage it. The device of this invention thereby facilitates the replacement or removal of fuse holders and in a manner substantially increasing the safety to the user.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims.

What is claimed is:

1. An improved hot stick and head therefor for removing a fuse holder from a pole mounted fuse type disconnect switch where the fuse holder is of the type having a tubular body with an eyelet extending radially outwardly near one end of the tubular body, comprising:

a hot stick adaptable to be held in the hands of the user and of a length to extend up to a pole mounted fused disconnect switch;

a tubular open top fuse holder catcher of an internal diameter greater than the external diameter of the fuse holder, the tubular catcher having a slot therein at one side extending from the open top to near the bottom, the slot being of width to slidably receive the eyelet of the fuse holder, the slot being tapered outwardly at the open upper end of the tubular catcher;

means attaching said tubular catcher to the upper end of said hot stick, the tubular axis of said catcher being parallel the axis of said hot stick;

and a hook member affixed to said hot stick at the upper end, the hook member extending radially of the axis of said hot stick and radially of the plane of the axis of said tubular catcher.

* * * * *